United States Patent [19]

Ono et al.

[11] Patent Number: 5,073,797

[45] Date of Patent: Dec. 17, 1991

[54] TONER SEALING ARRANGEMENT FOR A DRY DEVELOPING DEVICE OF AN ELECTROSTATIC COPIER

[75] Inventors: Taizo Ono, Hirakata; Hirotsugu Sakamoto, Ibaraki; Yoshihiro Katayama, Hirakata; Toshi Saitoh, Suita, all of Japan

[73] Assignee: Matsushita Electric Industrial Co., Ltd., Kadoma, Japan

[21] Appl. No.: 294,697

[22] PCT Filed: Mar. 23, 1988

[86] PCT No.: PCT/JP88/00301

§ 371 Date: Jan. 24, 1989

§ 102(e) Date: Jan. 24, 1989

[87] PCT Pub. No.: WO88/07707

PCT Pub. Date: Oct. 6, 1988

[30] Foreign Application Priority Data

| | | | |
|---|---|---|---|
| Mar. 24, 1987 | [JP] | Japan | 62-69333 |
| Apr. 2, 1987 | [JP] | Japan | 62-81460 |
| Apr. 17, 1987 | [JP] | Japan | 62-95664 |
| Jun. 4, 1987 | [JP] | Japan | 62-140285 |
| Dec. 1, 1987 | [JP] | Japan | 62-305054 |
| Dec. 8, 1987 | [JP] | Japan | 62-309850 |
| Dec. 17, 1987 | [JP] | Japan | 62-191627 |

[51] Int. Cl.[5] ..... G03G 21/00; G03G 15/06

[52] U.S. Cl. ..... 355/215; 355/245

[58] Field of Search ..... 355/245, 259, 215; 118/653, 661

[56] References Cited

U.S. PATENT DOCUMENTS

| | | | |
|---|---|---|---|
| 4,168,901 | 9/1979 | Ito et al. | 118/653 X |
| 4,596,455 | 6/1986 | Kohyama et al. | 355/259 X |
| 4,616,918 | 10/1986 | Kohyama et al. | 355/259 |
| 4,755,847 | 7/1988 | Matsushiro et al. | 355/259 |
| 4,777,512 | 10/1988 | Takahashi et al. | 355/208 |
| 4,836,135 | 6/1989 | Kohyama et al. | 118/653 |
| 4,930,438 | 6/1990 | Demizu et al. | 118/653 X |
| 4,947,211 | 8/1990 | Ono et al. | 355/259 X |

FOREIGN PATENT DOCUMENTS

| | | |
|---|---|---|
| 55-88083 | 7/1980 | Japan . |
| 55-118059 | 9/1980 | Japan . |
| 55-167239 | 12/1980 | Japan . |

*Primary Examiner*—Fred L. Braun

*Attorney, Agent, or Firm*—Cushman, Darby & Cushman

[57] ABSTRACT

The developing device provided in accordance with the invention includes a developer layer thickness controlling member for controlling the thickness of the developer through the developer carrier. The layer thickness controlling member is brought into press contact with the developer carrier downstream in the moving direction of the developer carrier. A first sealing member (48,49) is provided for cutting off the developer moving to both ends of the developer carrier. A second sealing member (50,51) is provided for shielding the junction of the developer carrier, the first sealing member, and the layer thickness controlling member. Finally, a sheet-shaped elastic body is provided for cutting off the developer which moves to the ends of the developer carrier.

4 Claims, 15 Drawing Sheets

TONER SEALING ARRANGEMENT FOR A DRY DEVELOPING DEVICE OF AN ELECTROSTATIC COPIER

TECHNICAL FIELD

The present invention relates to a developing apparatus in an image forming apparatus such as a copying machine and a printer applying electrophotographying.

BACKGROUND ART

Conventionally, there are two developing methods which employ dry developers a method using a developer of two-component system and a method using a developer of one-component system.

The method using the developer of two-component system uses a developer of mixture of toner and carrier, and therefore a toner density controlling apparatus for keeping the mixing ratio of toner and carrier constant is necessary. This method also has the deficiency that the developer must be of periodically replaced because of deterioration of the carrier and the like. For this reason, in recent years, to eliminate the above-mentioned deficiencies, a developing method by only a developer of one-component system which uses no carrier has been proposed.

This method is shown, for example, in the Japanese Published and Unexamined Patent Application No. sho 54-43038 and the U.S. Pat. No. 4,083,326, and the configurations thereof are shown in FIG. 1 and FIG. 2.

In FIG. 1 (Japanese Published Unexamined Patent Application No. sho 54-43038) numeral 1 designates a developing roller consisting of a cylindrical sleeve incorporating a magnet, numeral 2 designates a magnetic toner, numeral 3 designates a hopper, numeral 4 designates a blade and numeral 5 designates a photoreceptor. The developing roller 1 is constituted with a metallic material having an uneven surface, and the toner 2 is supplied from the hopper 3. Next, when the developing roller 1 is rotated in the direction as shown by an arrow, the toner 2 is charged in a predetermined polarity by the blade 4 brought in slide-contact with the surface of the developing roller 1, and is coated on the surface of the developing roller 1. Next, the charged toner 2 flies to develop when facing an electrostatic latent image of the photoreceptor 5.

In FIG. 2 U.S. Pat. No. 4,083,326), numeral 13 designates a developing roller, numeral 14 designates a toner, numeral 15 designates a hopper, numeral 16 designates a blade, numeral 17 designates a sheet-shaped photoreceptor, numerals 18 and 19 designate conductive fur brushes brought in slide-contact with the developing roller 13, numeral 11 designates a first power supply applying a voltage to the hopper 15 and the conductive fur brush 18, and numeral 12 designates a second power supply applying a voltage to the conductive fur brush 18 and a developing roller 7. Also, constitution is made in a manner that the voltage applied by the second power supply 12 is larger than the voltage applied by the first power supply 11, and is lower than the voltage of the electrostatic latent image of the photoreceptor 17. The toner 14 friction-charged by the fur brush 18 is supplied from the hopper 15 to the developing roller 13 through the conductive fur brush 18 by the potential difference between the first power supply 11 and the second power supply 12, and is subsequently smoothed by the blade 16, and adheres to the electrostatic image of the photoreceptor 17 to develop. Subsequently, after development the toner 14 on the developing roller 13 is scrubbed off by the conductive fur brush 19 to remove the hysteresis of development on the developing roller 13.

However, the method employing such a system has problems in forming a uniform thickness of layer of the developer (toner) on the developing roller and in charging characteristics, which make it difficult to reproduce a high-quality image. This means that, in FIG. 1 and FIG. 2, the toner adhering onto the developing roller 1 or 13 in a layer by rotation of the developing roller 1 or 13 is brought in contact with the blade 4 or 16, and is formed into a thin layer while scrubbed off in sequence from the uppermost layer. At this time, depending upon the position of the blade 4 or 16 pressed onto the developing roller 1 or 13, agglomerated toner is produced on the developing roller 1 or 13, or stripes are produced in the rotating direction or the axial direction of the developing roller 1 or 13, and thereby the layer thickness and the amount of charge of the toner on the developing roller 1 or 13 are varied, and resultantly an uneven density and toner scattering take place in developing, making it difficult to reproduce a high-quality image.

SUMMARY OF INVENTION

The present invention solves the conventional problems, and provides a developing apparatus capable of producing an image of high quality. Then, the present invention is characterized in that a developer is controlled to be uniformly charged and to have a predetermined layer thickness on a carrier of the developer. Also, in a developing apparatus in accordance with the present invention, a layer thickness controlling member is installed so as to be brought in press-contact with the developer carrier on the surface at least including the edge on the downstream side of the layer thickness controlling member in the moving direction of the developer carrier.

DETAILED DESCRIPTION OF THE PRESENTLY PREFERRED EXEMPLARY EMBODIMENTS

Hereinafter, description is made on embodiments in accordance with the present invention. FIG. 3 through FIG. 8 show a first embodiment of the present invention, which is an example of the use in an electrographic copying machine.

Figure 1:
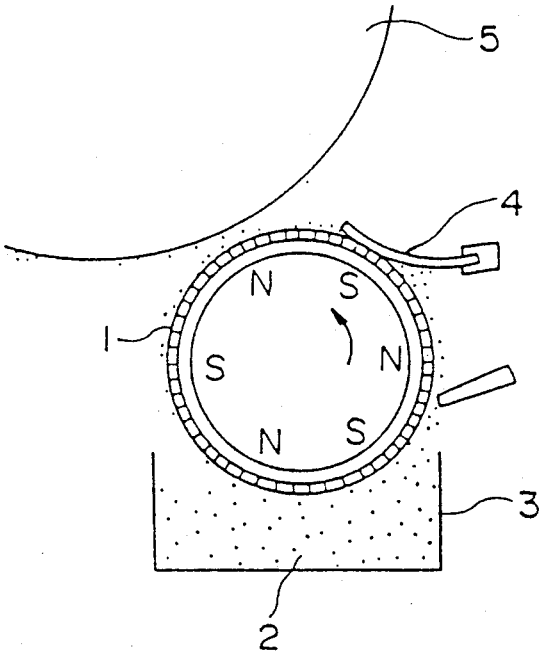
FIG. 1 (PRIOR ART)
FIG. 1 is a cross-sectional view of a major part of a conventional developing apparatus which uses a developer of the one-component system.
Figure 2:
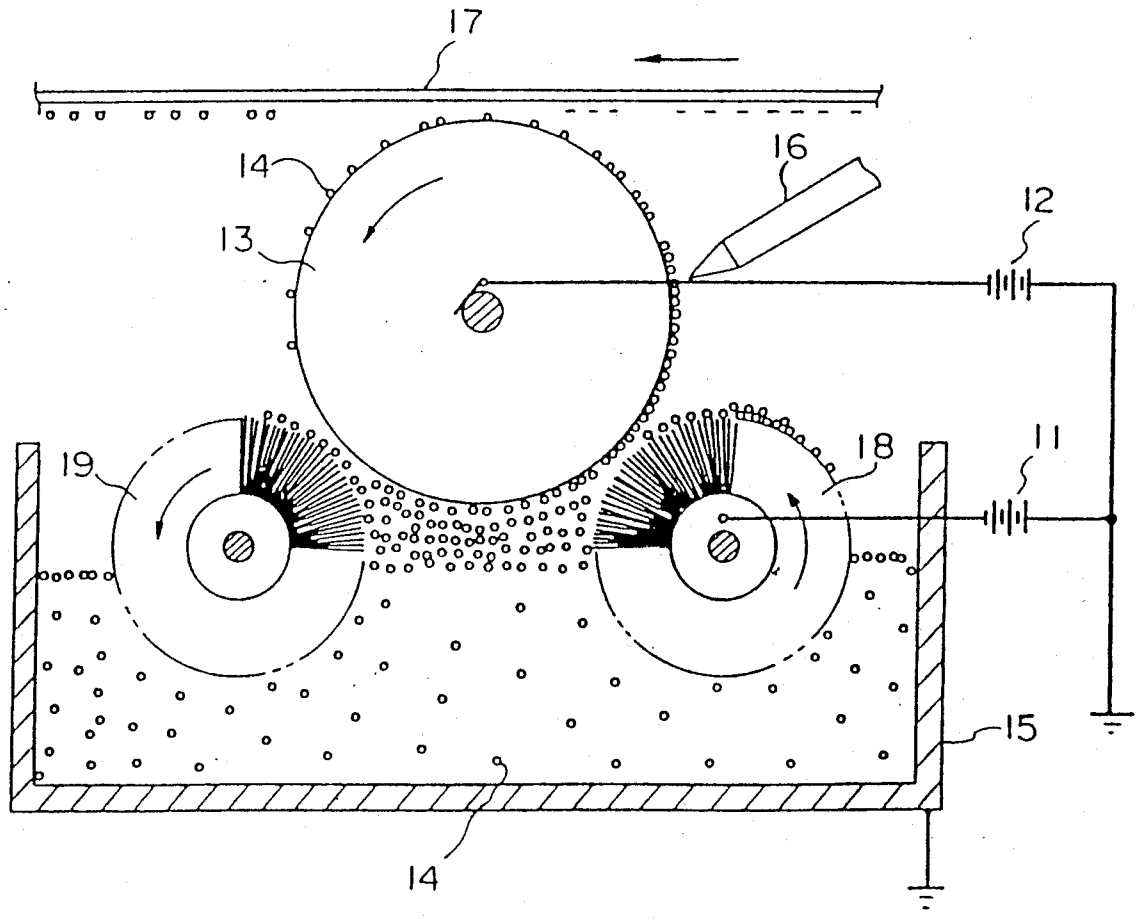
(PRIOR ART) FIG. 2
FIG. 2 is a cross-sectional view of a major part of a another conventional developing apparatus using a developer of one-component system.
Figure 3:
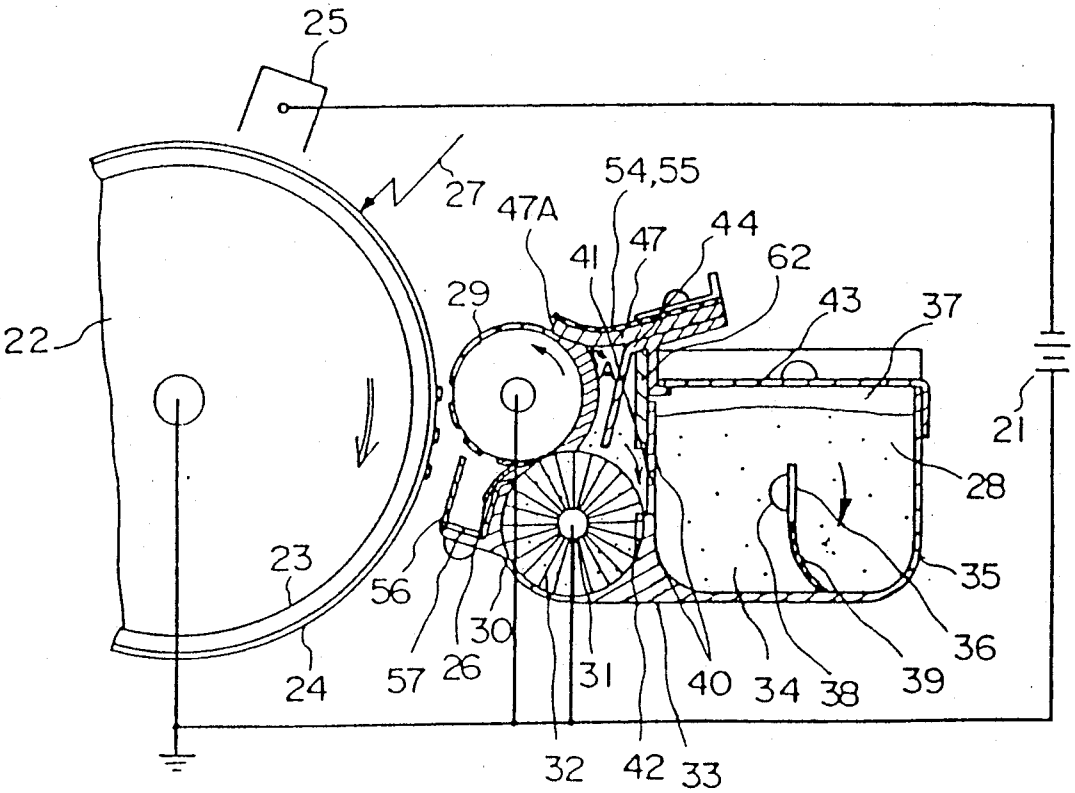
FIG. 3 is a cross-sectional view of a major part of a developing apparatus in accordance with the first embodiment of the present invention.
Figure 4:
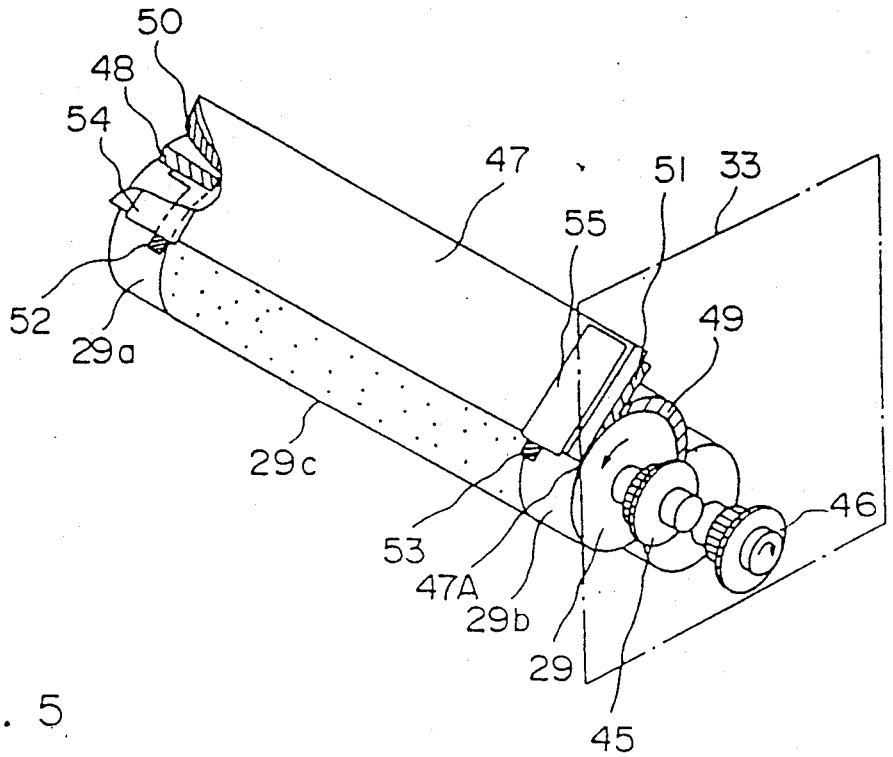
FIG. 4 is a configuration view of a portion of the developing apparatus provided in accordance with the first embodiment of the present invention.

In FIG. 3, numeral 22 designates a charge holder, which comprises electrostatic record paper, a photoreceptor-drum and so on, and in this case, it is a photoreceptor-drum. In this embodiment, the charger holder 22 is a photoreceptor-drum, which carries a photoconductor 24 such as zinc oxide, selenium, or an organic photoconductive material on the surface of an aluminal base body 23. Hereinafter, the charge holder 22 is referred to as the photoreceptor-drum 22. Numeral 25 designates a charger, which charges the entire surface of the photoconductor 24, for example, by giving it negative corona in the case of zinc oxide, or positive one in the case of selenium by a first DC high-voltage power supply 21 in response to the photoconductor 24 on the photoreceptor-drum 22. Numeral 27 designates an optical part, which forms an electrostatic latent image by projecting a pattern optical image onto the photoreceptor-drum 22. Numeral 28 designates a developer, which is a normal one-component insulative toner. In addition, the developer 28 may be a magnetic toner or a non-magnetic toner. Numeral 29 designates a developing roller being a carrier of developer, and, for example, a metallic roller of stainless steel, aluminum or the like or a metallic roller having the surface coated with resin is used. Preferably, as shown in FIG. 4, outer peripheral surfaces of both ends **29*a* and 29*b* of the developing roller 29 are smooth and central surface 29*c* has finely roughed surface, and it is installed with a certain interval kept from the photoreceptor-drum 22, and is rotated, for example, counterclockwise as shown in FIG. 1. Numeral 30 designates a cylindrical elastic body, which is a first supplying means for supplying the developer 28 to the developing roller 29, and the cylindrical elastic body 30 is a roller consisting of a fur brush or sponge, and a layer of an elastic material 32 is formed on the outer peripheral surface of a core metal 31**.

In this embodiment, the cylindrical elastic body 30 is a fur brush, and the elastic material 32 is constituted with conductive fur using rayon fibers containing carbon. Also, the fur brush 30 is surrounded by a housing 33, and is brought in slide-contact with the surface of the developing roller 29, and is rotated, for example, clockwise at a peripheral speed higher than that of the developing roller 29. By taking the peripheral speed of the fur brush as described above, the amount of supply of the developer 28 to the developing roller 29 is increased to improve compliance of coating, and to reduce scattering of the developer 28.

Figure 5:
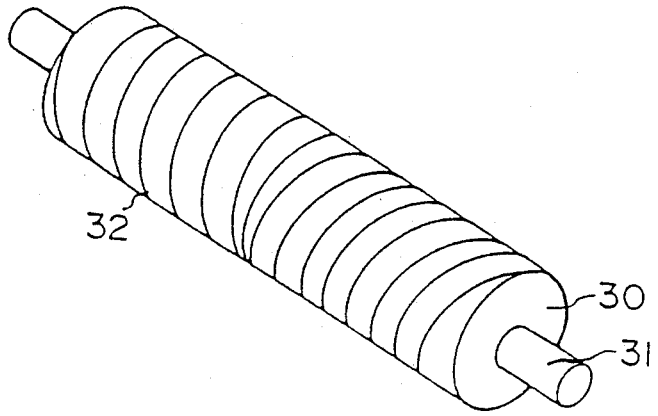
FIG. 5 is a configuration view of another portion of the developing apparatus in accordance with the first embodiment of the present invention.

Furthermore, after the developing process, the developer 28 adhering to the surface of the developing roller 29 is scrubbed off, and thereby the hysteresis on the developing roller 29 can be erased. Also, fibers of the fur brush 30, as shown in FIG. 5, are formed in a spiral shape in the directions that the developer 28 moves from the outer peripheral parts of both ends of the fur brush 30 to the central part when rotating. Numeral 34 designates a developer storing means, which is constituted with a storing part 35 storing the developer 28 and a second supplying means 36 for supplying the developer to the first suppling means 30. Also, the storing part 35 has an opening for refilling 37 the developer 28 at one end thereof, and is formed by part of the housing 33.

Also, the second supplying means 36 supplies the developer 28 to the first supplying means 30 in a manner that one end of a sheet-shaped elastic member 39, for example, consisting of polyethylenephthalate of about 30–80 μm in thickness or the like is fixed, and a core metal 38 is rotated or swung. In this embodiment, the core metal 38 is rotated clockwise. Numeral 40 designates a sectioning plate being a circulating means, which is installed between the first supplying means 30 and the second supplying means 36, and has an opening 41 where-through the developer 28 flows in and out between the first supplying means 30 and the second supplying means 36.

Numeral 42 designates a scrubbing plate, which is formed by part of the housing 33, and is brought in slide-contact with the fur brush 30 to equalize the amount of the developer 28 in the fur brush 30, and scrubs off the overcharged developer 28 in the fur brush 30. Numeral 43 designates a lid of the opening for refilling 37. Numeral 44 designates a partition plate, which is installed between the developer roller 29 and the supplying means 36 and at the position where the developer 28 in the storing part 35 is not supplied directly to the developer carrier 29. Also, a gap δ is formed between one end of the partition plate 44 and the outer peripheral surface of the fur brush 30. A good performance was obtained with the gap δ set to 0.5–3 mm.

Numeral 62 is for designating a residual amount detecting means for detecting the residual amount of the developer 28, and is installed between the partition plate 44 and the sectioning plate 40. The residual amount detecting means 62 is a well-known sensor which detects the amount of developer by means of vibration, permeability or the like. As shown in FIG. 4, numeral 45 designates a bearing of the developing roller 29, and numeral 46 designates a bearing of the fur brush 30.

Numeral 47 designates a blade, which is a layer thickness controlling member controlling the thickness of the layer of the developer 28, and in this embodiment, a rubber blade consisting of an elastic material of urethane rubber or the like is used; but as the material for the blade, other rubber materials, elastic synthetic resins such as ethylenetellephthalate, and elastic metal such as phosphor bronze, and spring steel can be used, and an elastic metal or a synthetic resin coated with fluorine resin can also be used. And, the precision and the mounting position of the end surface of the blade 47 have a great effect on forming a uniform thin layer of the developer 28, and therefore the straightness of the end of the blade 47 is finished as precisely as 0.15 mm or less, and the mounting position is set in a manner that the surface containing at least the edge of the blade 47 on downstream side in the moving direction of the developing roller 29 is brought in press-contact with the developer carrier. Furthermore, as shown in FIG. 4, the width of the blade 47 is set to a length that the blade 47 contacts the outer peripheral surfaces 29*a* and 29*b* of the both ends of the developing roller 29.

Numerals 48 and 49 designate first sealing members, which surround the outer peripheral surfaces 29*a* and 29*b* of the both ends of the developing roller 29 and cut off the developer 28 moving to the both ends thereof, and are constituted, with an elastic material such as woven cloth, non-woven cloth (felt), sponge or rubber. Numerals 50 and 51 designate second sealing members, which shield the space of junction of the developing roller 29, the first sealing members 48 and 49, and the blade 47, and are constituted, with an elastic material such as sponge, rubber or the like.

Numerals 52 and 53 designate elastic sheets for further cutting off the developer 28 moving to the both ends, which are constituted, for example, with an elastic material of polythylenetellephthalate of 70–150 μm in width, metal or the like. And, the elastic sheets 52 and 53 are installed between the developing roller 29 and the second sealing members 50 and 51 in a manner that one end of each is stuck to the first sealing member 48 or 49, and the other end of each is projected from the blade edge 47A on downstream side in the rotating direction of the developing roller 29.

Numerals 54 and 55 designate pressing plate spring improving close contact of the blade 47 with the developing roller 29, which are installed in a manner of pressing the second sealing members 50 and 51 and the elastic sheets 52 and 53 through the blade 47.

Figure 6:
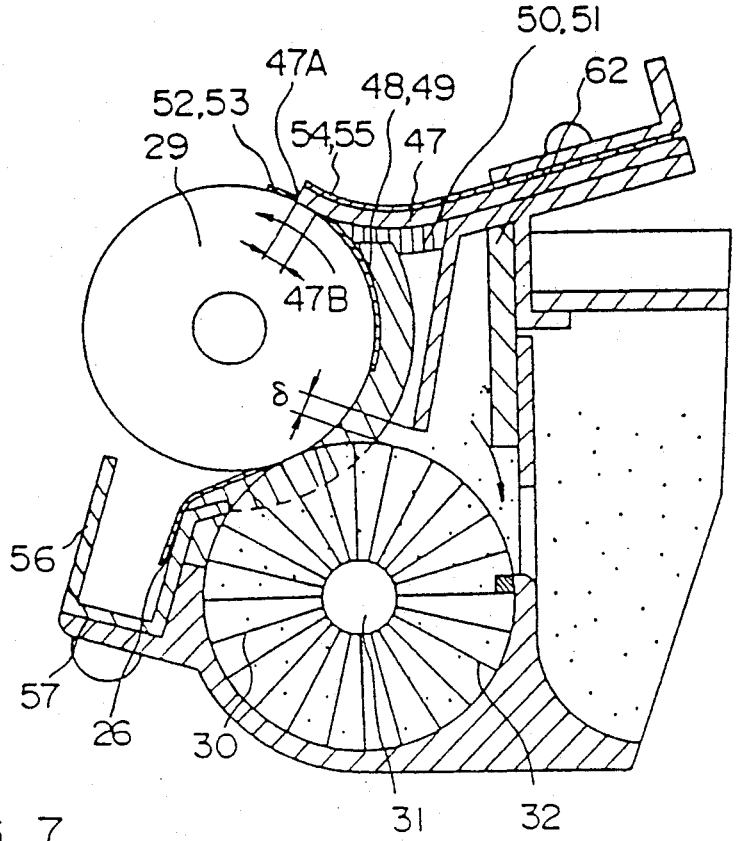
FIG. 6 is a configuration view of yet another portion of the developing apparatus of the first embodiment.
Figure 7:
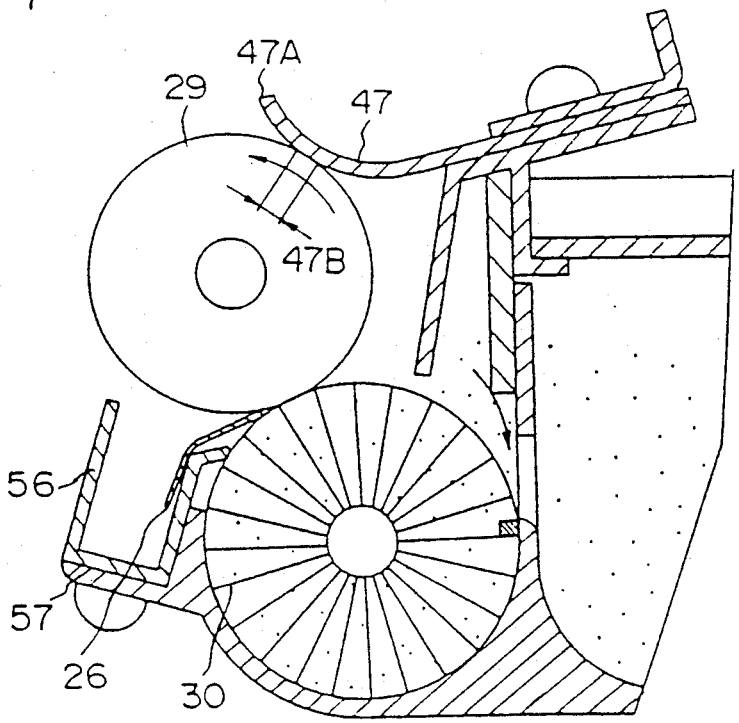
FIG. 7 is a configuration view of yet a further portion of the developing apparatus in accordance with the first embodiment.

Numeral 56 designates a means for preventing scattering of the developer 28, which is installed upstream from the position where the developing roller 29 and the fur brush 30 face each other in the moving direction of the fur brush 30 and under the developing roller 29. And, the scattering preventing means 56 is constituted with a U-shaped scattering preventive member 57 and a scattering preventive sheet 26 one end of which is fixed to the scattering preventive member 57 and the other end of which is brought in soft contact with the surface of the developing roller 29. In addition, one end of the scattering preventive sheet 26 of the scattering preventing means 56 may be installed in the housing 33. Also, the width of the scattering preventive sheet 26 is set to a length that the sheet 26 contacts the outer peripheral surfaces 29*a* and 29*b* of the both ends of the developing roller 29, and as shown in FIG. 6, the both ends thereof are brought in press-contact with the developing roller 29 by the sealing members 48 and 49 installed at the both ends of the developing roller 29. Furthermore, the end of a scattering preventive sheet 26 (sic) of the side brought in soft contact with the surface of the developing roller 29 is installed upstream from the line connecting the centers of the developing roller 29 and the fur brush 30 in the rotating direction of the fur brush 30. Also, for the leak preventive sheet 26, an elastic material such as polyethylenetellephthalate or urethane rubber is used, and in this embodiment, urethane rubber (in this case, the thickness is preferably about 50–200 μm) having a property of close contact with the developing roller 29 is used. The leak preventive member 57 is made of a metal such as stainless steel or aluminum, and even if the developer 28 should leak through the gap between the developing roller 29 and the leak preventive sheet 26, the sheet 57 catches it so as not to drop downward. In this case, leak of the developer 28 can be stopped nearly completely by the leak preventive sheet 26, and therefore the capacity of the leak preventive member 57 can be little.

In addition, the fur brush 30 prevents overcharge of the developer 28 generated by friction on the developing roller 29 and equalizes the potential by using a conductive material. Accordingly, for the fur brush 30, it is better to use a conductive material having a resistivity of about $10^{10}\Omega$cm or less, preferably $10^{3}\Omega$cm to $10^{7}\Omega$cm. And, for the fur brush 30, not only conductive rayon fibers as in the case with this embodiment, but also other conductive fibers may be used, and to equalize the coating, it is also effective to use a fur brush made by electrostatic fur planting. Furthermore, it is needless to say that the above-mentioned functions friction-charging and coating, etc. are performed effectively also by using conductive sponge, conductive cloth or a soft wire brush for the elastic material 32 for the cylindrical elastic body 30. In addition, where the developer 28 is a one-component magnetic toner, it is also effective to fabricate the elastic body 30 in a manner that a magnetic roller is used for the core metal 31 and a magnetic brush is formed on the outer peripheral thereof.

Description is made on the operation of the developing apparatus of the first embodiment constituted as described above.

Here, for easy understanding of the operation, the experiments were conducted by using the following; the photoconductor 24 on the photoreceptor-drum 22 is zinc oxide, the cylindrical elastic body 30 is a fur brush wherein rayon fibers containing carbon having a resistivity of about $10^{5}\Omega$cm are planted as the elastic material 32 by about 3600 lines/cm$^2$ on the aluminum core metal 31, the roughness of the surface of the developing roller 29 is 5 μm R max, the linear pressure of the blade 47 brought in press-contact with the developing roller 29 is 25 g/cm, the gap between the photoreceptor-drum 22 and the developing roller 29 is 0.15 mm, and the developer 28 is a normal positively charged non-magnetic one-component toner.

In FIG. 3, the whole surface of the photo-receptor-drum 22 is negatively charged to about-600 V by negative corona generated by applying a high voltage of about-6 KV to the charger 25 from the high-voltage DC power supply 21. Subsequently, a reflective image (pattern image) of a document irradiated by a halogen lamp or the like is projected onto the negatively charged photoreceptor-drum 22 by the optical part 27, and then the portion equivalent to a non-image part of the original on the photoreceptor-drum 22 is discharged to the residual potential nearly equal to 0 V by the reflected light to form a positive electrostatic latent image. During that time, the developer 28 in the storing part 35 is supplied into the fur brush 30 through the opening 41 by the second supplying means 36. The developer 28 is prevented from being supplied directly to the developing roller 29 by the partition plate 44 during this time of supply, and therefore the not-yet-charged developer 28 never adheres to the developing roller 29.

Subsequently, the excessive developer 28 in the fur brush 30 is scrubbed off by the scrubbing plate 42 to be supplied by a proper amount, and the developer 28 is charged positively by friction with the scrubbing plate 42 and the housing 33. An electric field is generated between the developing roller 29 and the fur brush 30 by the charged developer 28 in the fur brush 30, and the charged developer 28 is coated on the surface of the developing roller 29. At this time, the developer 28 supplied by a proper amount is positively charged further uniformly by friction with the surface of the developing roller 29 caused by rotation of the fur brush 30. Accordingly, the uniformly charged developer 28 is coated on the developing roller 29, and thereby a high-quality image is obtainable. Here, the thickness of the layer of the developer 28 on the surface of the coated developing roller 29 is a predetermined value on more, and has some dispersion. Subsequently, the developer 28 charged on the surface of the developing roller 29 by rotation of the developing roller 29 is partly scrubbed off by the blade 47 when it passes through the blade 47, and the thickness thereof is controlled to keep a predetermined value, that is, about 40 μm (the layer thickness at this time is desirably about 10–70 μm). Also, the end surface of the blade 47 is finished to a straightness of 0.15 mm or less, and as shown in FIG. 6, the blade 47 is installed so as to be brought in press-contact with the developing roller 29 on the surface 47B containing at least the edge 47A of the blade 47 on the downstream side in the moving direction of the developing roller 29, and therefore the thickness of the layer and the amount of charge on the developing roller 29 are equalized. As a result, unevenness of density and scattering of the developer do not take place. Further detailed description is made on the blade position on the basis of FIG. 7 and the results of the experiments.

The position of the surface 47B containing at least the edge 47A of the blade 47 on the downstream side in the moving direction of the developing roller 29 refers to the position that the edge 47A is installed within the range of a nip surface, which is formed when the edge 47A of the blade 47 is not brought in contact with the surface of the developing roller 29. And, the results of the experiments are as follows:

(1) The image density is higher when the contact with the developing roller 29 is made by the nip surface of the blade 47.

(2) Agglomeration of the developer takes place when the edge 47A of the blade 47 does not contact the developing roller 29.

(3) Stripes that the developer layer does not exist in the axial direction of the developing roller 29 are likely to take place when contact with the developing roller 29 is made only at the edge 47A of the blade 47.

(4) Stripes of the developer layer in the rotating direction of the developing roller 29 are likely to take place when contact with the developing roller 29 is made only at the edge 47A of the blade 47.

(5) Ground fogging is likely to take place when contact with the developing roller 29 is made only by the edge 47A of the blade 47.

Presuming from the above-mentioned results, when press-contact with the developing roller is made by the blade nip surface, vibration of the blade is reduced and friction-charging of the developer is improved and a developer layer having a more uniform thickness is formed. And where press-contact with the developing roller is made by the edge of the blade, vibration of the blade is increased and friction-charging of the developer is worsened, and stripes are produced in the rotating direction of the developing roller or ground fogging takes place. Furthermore, it is considered that the stripes that the developer layer does not exist in the axial direction of the developing roller were produced because of a high linear pressure of the blade. Also, it is considered that when the edge surface of the blade did not contact the developing roller, the facing distance between the developing roller and the blade after controlling the layer thickness was enlarged, the charged developer on the developing roller flew and adhered to the blade, the developer stayed between the developing roller and the blade, and the developer agglomerated. Accordingly, the mounting position of the blade is set so as to be brought in press-contact with the developer carrier by the surface containing at least the edge of the blade on the downstream side in the moving direction of the developing roller in order to equalize both the thickness of the layer and the amount of charge of developer on the developing roller.

The developer 28 contacting the blade 47 drops to the fur brush 30 while moving from the central part toward the both ends of the developing roller 29. Subsequently, the developer 28 is moved from the both ends to the central part of the fur brush 30 by rotation of the spiral fur brush 30. For this reason, the developer 28 in the vicinity of the both ends of each of the developing roller 29 and the fur brush 30 is not increased, and the effect that the height of the developer 28 in the storing part 35 is kept constant is obtained. Furthermore, since the tightly enclosing structure of surrounding the outer peripheral surfaces **29*a* and 29*b* of the both ends of the developing roller by the first sealing members 48 and 49, the second sealing members 50 and 51 and the elastic sheets 52 and 53 is adopted, scattering and leakage of the developer 28 moving to the both ends of the developing roller 29 do not take place. This means that this developing apparatus uniformly charges the developer 28 on the developing roller 29, can equalize the layer thickness, further eliminates scattering and leakage of the developer 28**, and can obtain a high-equality image without fogging and uneven density.

When a negatively charged electrostatic latent image on the photoreceptor-drum 22 faces the positively charged developer 28, the developer 28 is caused to fly by an electrostatic force of the electrostatic latent image of the photoreceptor-drum 22, and can develop the latent image. Next, the surplus developer 28 which has not been used for development is further carried downstream while adhering intact to the developing roller 29, and passes through the leak preventive sheet 58. At this time, the leak preventive sheet 26 makes soft contact with the developing roller 29, and therefore the developer 28 is carried intact in the housing 33 by an electrostatic adhering force, and when passing through the leak preventive sheet 26 once, it never leaks outside.

The developer 28 adhering to the surface of the developing roller 29 is scrubbed off by the fur brush 30, and the hysteresis of the developing roller 29 is erased. Accordingly, a high-quality image without ghost is obtainable. Next, the developer 28 scrubbed off by the fur brush 30 is carried by the fur brush 30, and is subsequently scrubbed off by the scrubbing plate 42, and is returned into the storing part 35 through the opening 41, and therefore the developer 28 on the developing roller 29 is not over-charged. Accordingly, a high-image-quality development can be performed. In this state of development, the developer 28 is in the storing part 35, and therefore the presence of the developer 28 is detected by the residual amount detecting means 62 from that the developer 28 stays between the partition plate 44 and the sectioning plate 40 when the developer 28 is supplied by the second supplying means 36.

Figure 8:
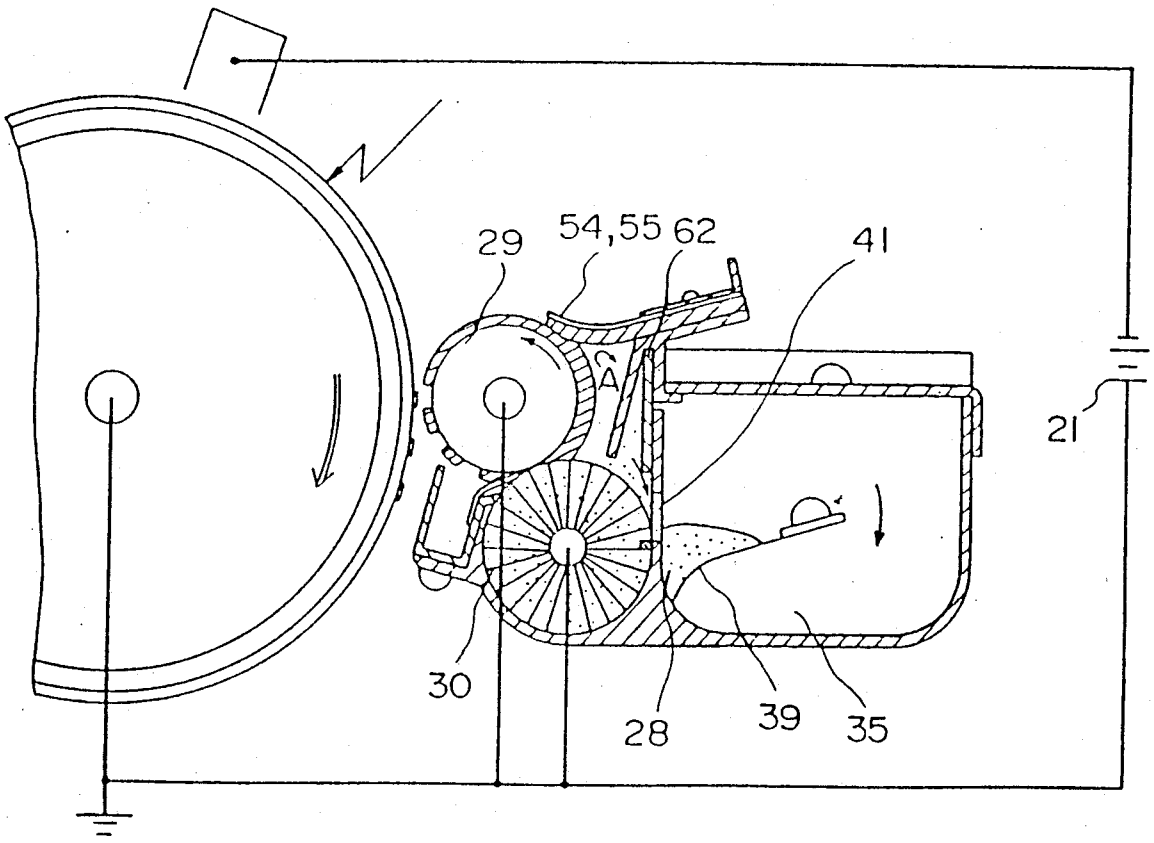
FIG. 8 is a cross-sectional view of a major part of the developing apparatus provided in accordance with the first embodiment of the invention.

The second supplying means 36 repeats the above-mentioned developing process, and even if the amount of the developer 28 in the storing part 35 is reduced, the sheet-shaped elastic member 39 displaces as shown in FIG. 8 because of the clockwise rotation, and thereby the developer 28 can be supplied all the time into the fur brush 30 through the opening 41. Consequently, even when the bottom surface of the storing part 35 is made horizontal, the developer 28 in the storing part 35 can be supplied to the fur brush 30 without trouble to the last. Also, the developer 28 is stirred in the storing part 35 by the sheet-shaped elastic member 39, and therefore an effect is obtainable that the height of the developer 28 in the storing part 35 is kept constant. Next, since the developer 28 does not stay between the partition plate 44 and the sectioning plate 40 when the developer 28 runs out in the storing part 35, the absence of the developer 28 is detected by the residual amount detecting means 62. In addition, since the peripheral speeds of the developing roller 29 and the photoreceptor-drum 22 are set to the same, the edge effect when the latent image is developed can be eliminated.

In this developing apparatus, the developer is not supplied directly by the partition plate, and therefore the non-charged developer never adheres to the developing roller. Also, since the charged developer on the developing roller is returned into the developer storing means by the circulating means, the over-charged developer does not exist on the developing roller. Accordingly, high-image-quality development can be performed. Also, since supply of the developer to the developing roller and scrubbing off of the developer on the developing roller after development can be carried out by one fur brush, the configuration is simplified and made smaller in size. In addition to it, since the configuration without leakage and scattering of the developer is adopted, the restriction on the arrangement of the developing apparatus can be loosened.

In addition, in this embodiment, description is made on the example of the experiments on normal development (posi-posi development) in the electrophotographic copying machine, but it is needless to say that the present invention is applicable also to the reversal development (nega-posi development) in the laser printer or the like.

Figure 9:
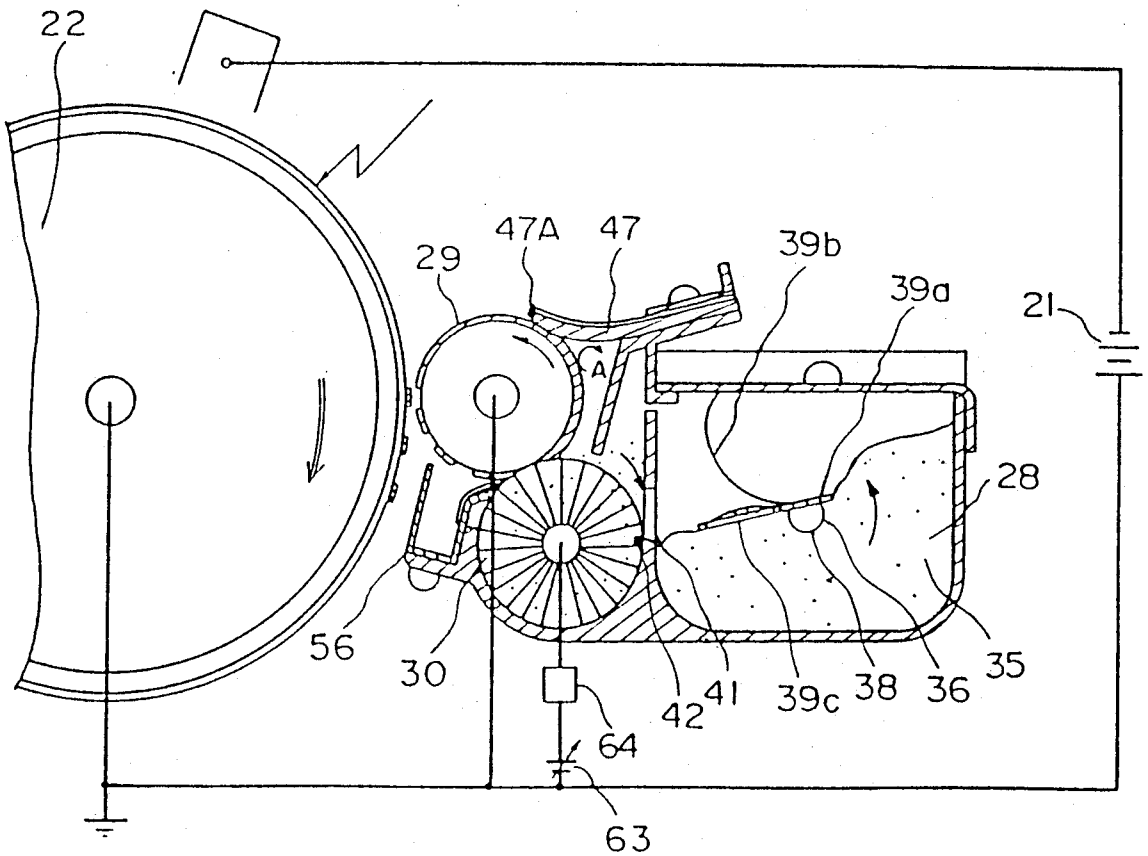
FIG. 9 is a cross-sectional view of a major part of a developing apparatus in accordance with the second embodiment.

Next, description is made on a second embodiment in accordance with the present invention. FIG. 9 shows the second embodiment of the present invention, and the same numbers are attached to the members having the same function as in the case of the first embodiment. The second supplying means 36 is constituted in a manner that at least two blades **39*a* and 39*b* are installed on the outer peripheral surface of the core metal 38, and are rotated in the storing part 35. Also, as to the blades 39*a* and 39*b*, the blade 39*a* on the downstream side in the rotating direction of the blades has a larger elastic force than that of the blade 39*b* on the upstream side, and one end of the blade 39*b* is brought in soft contact with the inner wall of the storing part 35, and one end of the blade 39*a* is installed close to the inner wall of the storing part. Furthermore, an opening hole 39*c* is installed in the blade 39*a*. In this embodiment, as the blade 39*b* a sheet-shaped elastic material consisting of polyethylenetellephthalate of about 30 μm in thickness or the like is used but as the elastic material, rubber material such as urethane or neoprene, an elastic synthetic resin film of polystyrene, teflon, etc. or an elastic metal such as phosphor bronze or spring steel can be used. And, as the blade 39*a* uses a rigid body material of aluminum plate is used, but as the 25 rigid body material, a metal such as stainless steel or metals coated with fluoric resin, hard resin or ceramics can also be used. The core metal 38** rotates counter-clockwise.

Figure 10:
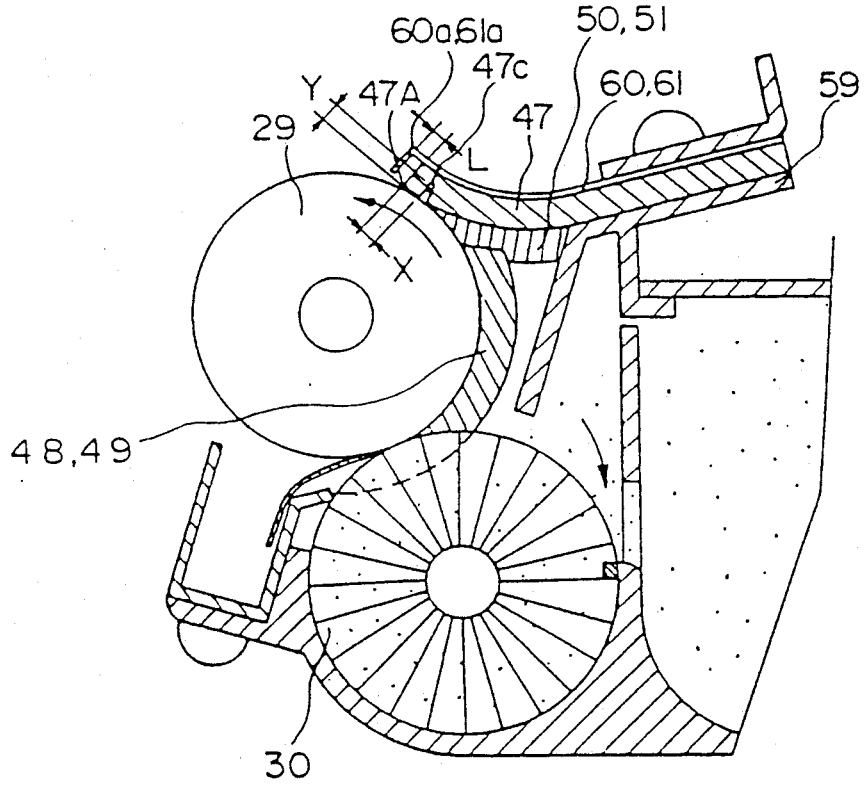
FIG. 10 is a cross-sectional view of a major part of a developing apparatus in accordance with the second embodiment of the invention.

The blade 47 is constituted with a rubber elastic material, and as shown in FIG. 10, notches of the blade 47C are formed on the both end surfaces of the blade 47 contacting the both end surfaces **29*a* and 29*b* of the developing roller. The notches of the blade 47C is for cleaning the developer 28 adhering to the both end surfaces 29*a* and 29*b* of the developing roller, and is located in parallel with and apart from the blade edge 47A by X=about 1 mm and has a depth Y of 0.5 mm or more, and is smaller than the thickness of the blade 47. The second sealing members 50 and 51 cut off the space of the junction of the both end surfaces 29*a* and 29*b* of the developing roller, the first sealing members 48 and 49 and the blade 47, and is installed between the notches 47C and a mounting bed 59. Numerals 60 and 61 designate pressing plate springs, which are installed so as to press the second sealing members 50 and 51, and improve close contact of the blade with the developing roller 29. Also, one end of the blade edge side 47A of each of the pressing plate springs 60 and 61 is bent in the direction of press-contact of the blade 47. These bent parts 60*a* and 61*a* are for preventing excessive deformation of the notches of the blade 47C when the developing roller 29 is rotated, and in this embodiment, they are formed to have length so that they do not contact the surface of the developing roller 29** at the position of L=0.2–0.5 mm apart.

The peripheral speed of the fur brush 30 is set slower than the peripheral speed of the developing roller 29. Therefore, the developer 28 adhering to the surface of the developing roller 29 after the developing process can be scrubbed off. Numeral 63 designates a second DC high-voltage power supply being a first voltage applying means, which applies a voltage between the developing roller 29 and the fur brush 30 and thereby adjusts the layer thickness of the developer 28 charged on the surface of the developing roller 29. Numeral 64 designates a detecting means which detects the current value of the second DC high-voltage power supply and detects presence or absence of the developer 28.

Next, description is made on operation of the second embodiment of the present invention. The developer 28 is supplied from the second supplying means 36 into the fur brush 30 through the opening 41. The method of supply at this time is such that most of the developer 28 in the storing part 35 is carried by the blade **39*a* having a strong elastic force, and the developer 28 on the inner wall of the storing part 35 is carried in a soft contact fashion by the blade 39***b* having a weak elastic force. Accordingly, the developer 28 can be supplied into the fur brush 30 to the last without being damaged. Furthermore, since the opening hole 39*c* is installed in the blade 39*a*, the developer 28 is never sandwitched between the blade 39*a* and the blade 39*b*. Accordingly, the carriage of the developer 28 is further kept constant. In addition, in this embodiment, one end of the blade 39*b* is brought in soft contact with the inner wall of the storing part 35, and one end of the blade 39*a* is installed close to the inner wall of the storing part 35, but the two blades 39*a* and 39*b* may be installed in a manner that one end of each of them faces the inner wall of the storing part 35, and the length of the blade 39*b* is set longer than the blade 39*a* toward the inner wall of the storing part 35 and close to the inner wall of the storing part 35. In the operation at this time, the angle of bend of the blade 39*b* having a weak elastic force is varied depending on the amount of the developer 28 in the storing part 35.

For this reason, when the amount of the developer 28 in the storing part 35 is large, the blade 39*b* is bent by the load of the developer 28, and most of the developer is carried by the blade 39*a*. Next, when the amount of the carrier 28 in the storing part 35 is small, the blade 39*b* restores by the elastic force thereof, and thereby the developer 28 on the inner wall of the storing part 35 can be carried in a soft contact fashion. Accordingly, the developer 28 can be supplied into the fur brush 30 to the last without being damaged.

The excessive developer 28 in the fur brush 30 is scrubbed off by the scrubbing plate 42, and is supplied by a proper amount, and is positively charged by friction with the scrubbing plate 42 and the housing 33. Furthermore, this developer 28 is carried to the position where it faces the developing roller 29 by rotation of the fur brush 30, and the developer 28 charged on the surface of the developing roller 29 is coated. Next, a voltage is applied between the developing roller 29 and the fur brush 30 by the second DC high-voltage power supply 63, and thereby the layer thickness of the developer 28 charged on the surface of the developing roller 29 is adjusted.

In addition, the second DC high-voltage power supply 63 can adjust the layer thickness with applying voltages of about ±30 V to ±250 V. And, at this time, by application of, for example, a voltage that the fur brush 30 side is positive between the developing roller 29 and the fur brush 30 by the second DC high-voltage power supply 63, when the developer 28 is carried from the fur brush 30 to the developing roller 29 by an electric field therebetween, even though there exist, for instance, the not-yet-charged developer 28 and the reverse-sign charged developer in the developer 28, not-yet-charged and charged developers are difficult to be carried, and only the normally charged developer 28 is selected to contribute to development.

In this state of development, a proper amount of developer 28 exists in the fur brush 30, and therefore the contact resistance between the fur brush 30 and the developing roller 29 is high, and therefore the current value of the detecting means 64 is small.

This developing process is repeated, and when the developer 28 in the storing part 35 and the developer 28 in the fur brush 30 run out, the above-mentioned contact resistance is reduced, and the current value of the detecting means is increased. Accordingly, presence or absence of the developer 28 in the storing part 35 can be detected by the current value of the detecting means 64. And, since the blades 39*a* and 39*b* rotate to stir the developer 28, an effect of keeping the height of the developer 28 in the storing part 35 constant is obtained. Here, the layer thickness of the developer 28 on the surface of developing roller 29 coated adjusting the voltage of the second DC high-voltage power supply 63 reaches a predetermine value or more, and has some dispersion. Also, the developer 28 in the fur brush 30 flies and adheres onto the developing roller 29 by the voltage of the second DC high-voltage power supply 63, and therefore the rise time till the developer 28 reaches to a predetermined layer thickness can be reduced to as short as one second or less, and hence an extra waiting time is not required.

Next, the developer 28 charged on the surface of the developing roller 29 by rotation of the developing roller 29 is further positively charged by the blade 47 when passing through the blade 47, and is partly scrubbed off to be controlled to be kept at a predetermined layer thickness. At this time, the developer 28 moving to the both ends of the developing roller 29 is cut off by the first sealing members 48 and 49 and the second sealing members 50 and 51. Also, if the developer 28 should spread to the both ends 29*a* and 29*b* of the developing roller, cleaning is made by the edges of the notches of the blade 47C, and therefore leakage of the developer 28 can be prevented.

When the negative-charged electrostatic latent image on the photoreceptor-drum 22 faces the positive-charged developer 28 on the developing roller 29, the developer 28 is caused to fly by an electrostatic force of the electrostatic latent image on the photoreceptor-drum 22, and can develop the latent image. After the development, the developer 28 adhering to the surface of the developing roller 29 is scrubbed off by the fur brush 30 to erase the hysteresis of the developing roller 29. Accordingly, a high-quality image without ghost is obtainable.

When one end of the blade 39*a* faces the opening 41 by counterclockwise rotation of the core metal 38 of the second supplying means 36, a space part can be formed between the blade 39*a* and the blade 39*b*. Consequently, the developer 28 on the developing roller 29 after development is carried by the fur brush 30, and is subsequently scrubbed off by the scrubbing plate 42, and is returned to the above-mentioned space part in the storing part 35 through the opening 41, and subsequently the developer 28 can flow out of the opening hole 39*c* of the blade 39*a* by the elastic force of the blade 39*b*. Accordingly, overcharging of the developer 28 can be further prevented, and the effect of scrubbing off by the scrubbing plate 42 can be enhanced.

Figure 11:
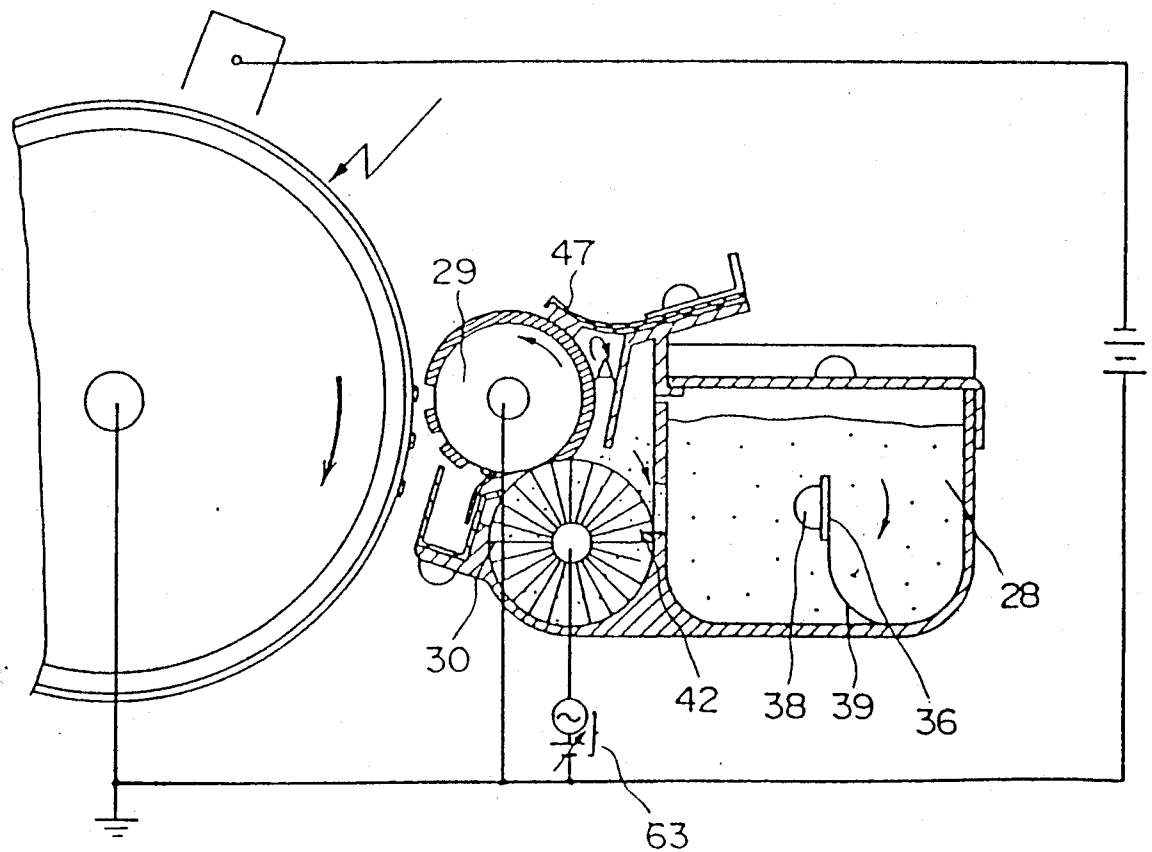
FIG. 11 is a cross-sectional view of a developing apparatus in accordance with a third embodiment of the invention.
Figure 12:
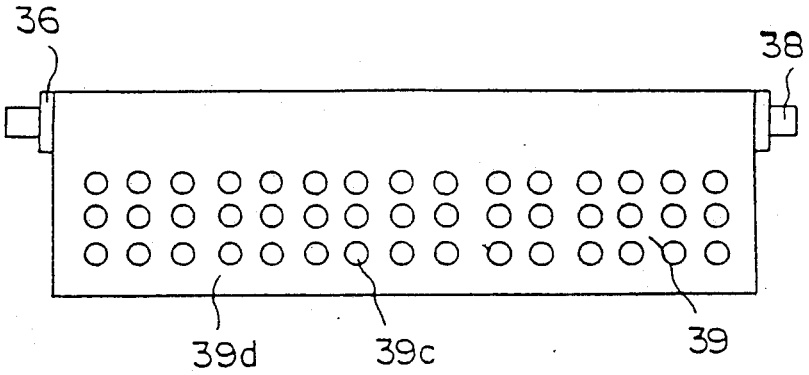
FIG. 12 is a cross-sectional view of the developing apparatus in accordance with the third embodiment.
Figure 13:
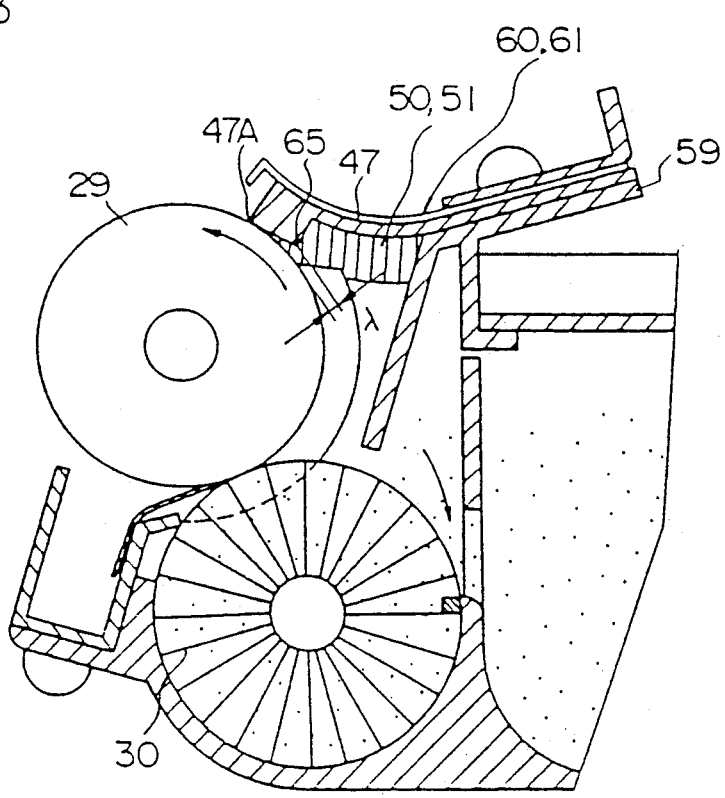
FIG. 13 is yet a further cross-sectional view of the developing apparatus in accordance with the third embodiment.

Next, description is made on a third embodiment of the present invention. In FIG. 11 through FIG. 13, the members having the same function as in the cases of the first and the second embodiments are designated by the same numbers. In FIG. 11, the second supplying means 36 can supply the last developer 28 to the fur brush 30, and as shown in FIG. 12, a plurality of opening holes 39*c* are formed except for a free end 39*d* on the blade 39 in the developing apparatus to reduce the air compressing force, and the core metal 38 is rotated clockwise. Also, the diameter of the opening hole 39*c* is preferably $\phi 4$–$\phi 10$ from the performance of supplying the developer 29 and reduction of the air compressing force into account. The blade 47 which is a layer thickness controlling member, as shown in FIG. 13 is shaped that at least the portion of press-contact with the developing roller 29 is formed in a protruded shape, and an edge line of the protruded portion 65 on the side of the fur brush 30 is disposed with a small gap λ (λ is preferably 0.05–0.5 mm) kept from the developing roller 29. Also, the peripheral speed of the fur brush 30 is the same as the peripheral speed of the developing roller 29. The first voltage applying means 63 applies a voltage that a positive DC voltage is superposed on an AC voltage between the developing roller 29 and the fur brush 30 to the fur brush 30 side, and thereby adjusts the layer thickness of the developer 28 charged on the surface of the developing roller 29.

Description is made on the operation of the third embodiment. In FIG. 11, by installing the first voltage applying means 63 which superposes a DC voltage on an AC voltage, the developer 28 can be coated on the developing roller 29 with a predetermined layer thickness or thicker, and further the developer 28 adhering to the surface of the developing roller 29 after development is moved reciprocatively between the fur brush 30 and the developing roller 29 by the above-mentioned AC voltage, and thereby the hysteresis of the developing roller 29 is erased, and mutual agglomeration of the developer 28 and a strong adhering force of the developer 28 to the developing roller 29 can be prevented. Accordingly, a high-quality image without ghost is obtainable.

Also, the blade 47 being a layer thickness controlling member equalizes the amount of supply of the developer 28 on the developing roller 29 by means of a small gap λ, and subsequently can control the developer to have a uniform predetermined layer thickness by means of the protruded press-contacting surface. Furthermore, the developer 28 partly scrubbed off by the blade 47 is changed its flow in the direction shown by an arrow A along the wall surface of the protruded portion of the blade 47 by the force of the subsequent developer 28, and drops to the fur brush 30 side. As a result, in the facing part of the developing roller 29 and the blade 47 in the vicinity of the above-mentioned press-contacting part, the developer 28 is returned thereto, and therefore more uniform coating can be carried out. Accordingly, a high-quality image without uneven density can be obtained without requiring adjustment of high precision and with a simple configuration. Also, the core metal 38 of the second supplying means 36 is rotated clockwise, and the last developer 28 can be supplied to the fur brush 30 by the free end 39*d* of the blade 39*a*. And, the developer 28 is not scattered from the developing apparatus because the air compressing force is reduced by a plurality of the opening holes 39*c* in the developing apparatus.

Figure 14:
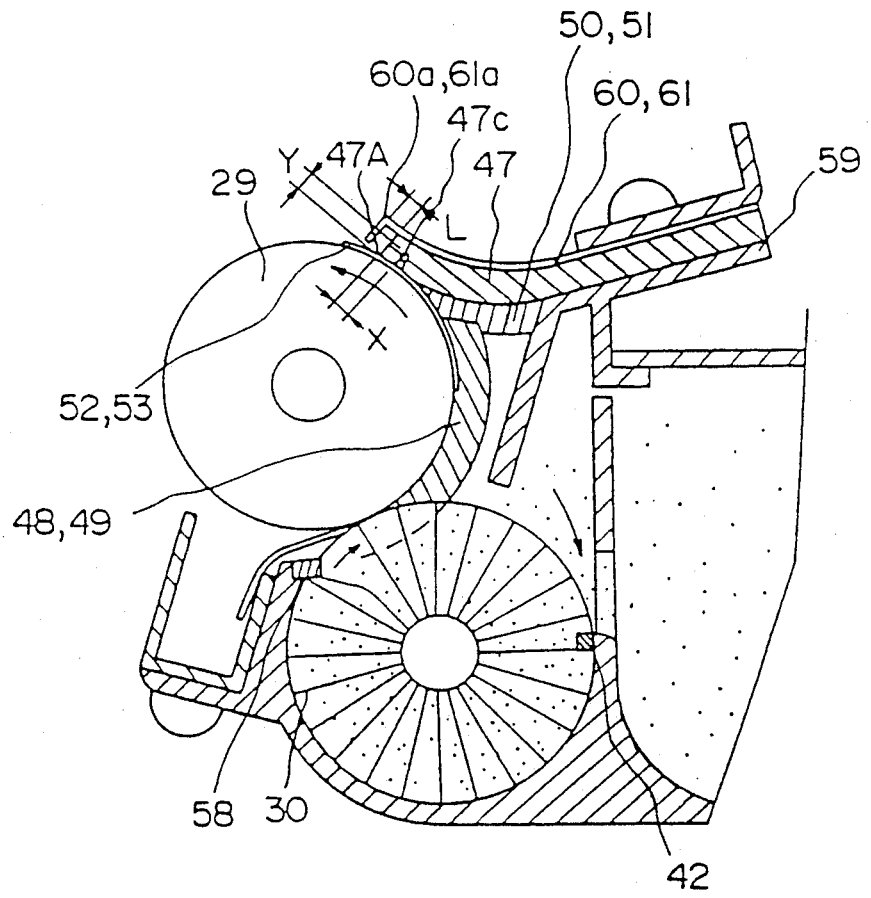
FIG. 14 is a cross-sectional view of a major part of a developing apparatus in accordance with a fourth embodiment of the invention.
Figure 15:
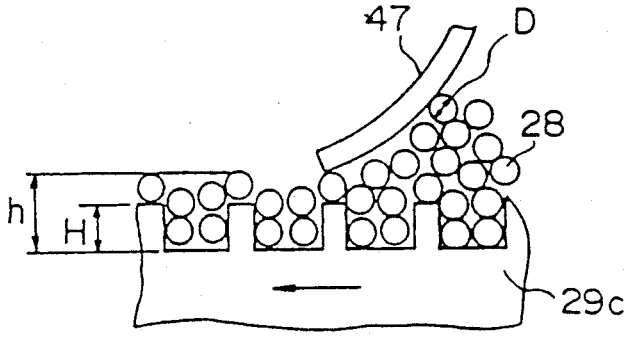
FIG. 15 is a cross-sectional view of another part of the developing apparatus in accordance with the fourth embodiment of the present invention.
Figure 16:
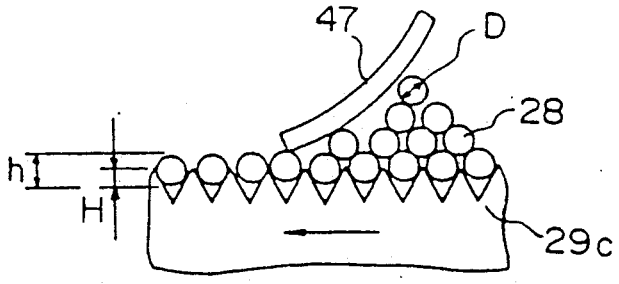
FIG. 16 is a cross-sectional view of yet another part of the developing apparatus in accordance with the fourth embodiment of the present invention.

Next, description is made on a fourth embodiment of the present invention. FIG. 14 through FIG. 16 show the fourth embodiment of the present invention. In FIG. 14, the members having the same function as in the case of the third embodiment are designated by the same numbers. The blade 47 is constituted in a manner that in the blade 47 as shown in FIG. 10 one end of each of the elastic sheets 52 and 53 is stuck to each of the first sealing members 48 and 49, and the other ends thereof are projected on the downstream side from the blade edge 47A in the rotating direction of the developing roller 29, and are installed between the developing roller 29 and the second sealing members 50 and 51, and thereby to prevent scattering and leakage of the developer 28 further moving to the both ends of the developing roller 29. The outer peripheral surfaces of the both ends 29*a* and 29*b* of the developing roller 29 are smooth, and a finely uneven-rough surface is formed on the central surface 29*c*. Also, as shown in FIG. 15 and FIG. 16, the uneven-rough surface 29*c* is formed to hold a relation, $0 \leqq h-D<H$, taking the average particle size of the developer 28 as D, a predetermined layer thickness as h, and the depth of the above-mentioned uneven part as H. In addition, the depth of the uneven part is taken as the distance from the bottom surface of the lowermost layer of the developer 28 in the uneven part to the uppermost surface of the developing roller 29. Numeral 58 designates a fixed plate, which is a flying means formed integrally with 33, and is brought in contact with the outer periphery of the fur brush 30 on the upstream side from the position of contact of the developing roller 29 and the fur brush 30 in the moving direction of the fur brush 30, and as shown in FIG. 14, is installed so as to deform the tip of the fur brush 30.

Next, description is made on the operation in the fourth embodiment. In FIG. 14, when the fur brush 30 rotates and passes through the fixed plate 58, the developer 28 can be flown and made to adhere onto the developing roller 29 by the restoring force of the fur brush 30. Accordingly, because of the flying adhesion of the developer 28, mutual agglomeration of the developer 28 is eliminated, and the rise time till the developer 28 reaches a predetermined layer thickness can be further reduced, and therefore an extra waiting time is not required. And, since the fixed plate 65 is installed on the upstream side in the vicinity of the facing position in a manner of contacting the fur brush 30, leakage of the developer 28 is further eliminated. Next, when the charged developer 28 on the developing roller 29 passes through the blade 47 by rotation of the developing roller 29, it is further positive charged by the blade 47, partly scrubbed off, and is controlled to be kept in a predetermined layer thickness. At this time, the developer 28 moving to the both ends of the developing roller 29 is cut off by the first sealing members 48 and 49, the second sealing members 50 and 51 and the elastic sheets 52 and 53. And, if the developer 28 should spread to the both ends 29*a* and 29*b* of the developing roller, it is cleaned by the edges of the notches of blade 47C, and therefore leakage of the developer 28 can be prevented. And, as shown in FIG. 15 or FIG. 16, the layer thickness is controlled to be kept at a predetermined value in the state that the developer 28 adheres to the uneven part and the upper most surface of the developing roller 29. Consequently, the reproductivity of a fine-line image is improved by the developer 28 on the uppermost surface, and an image of uniform density is obtainable by keeping the amount of developer 28 in the recess part constant.

Figure 17:
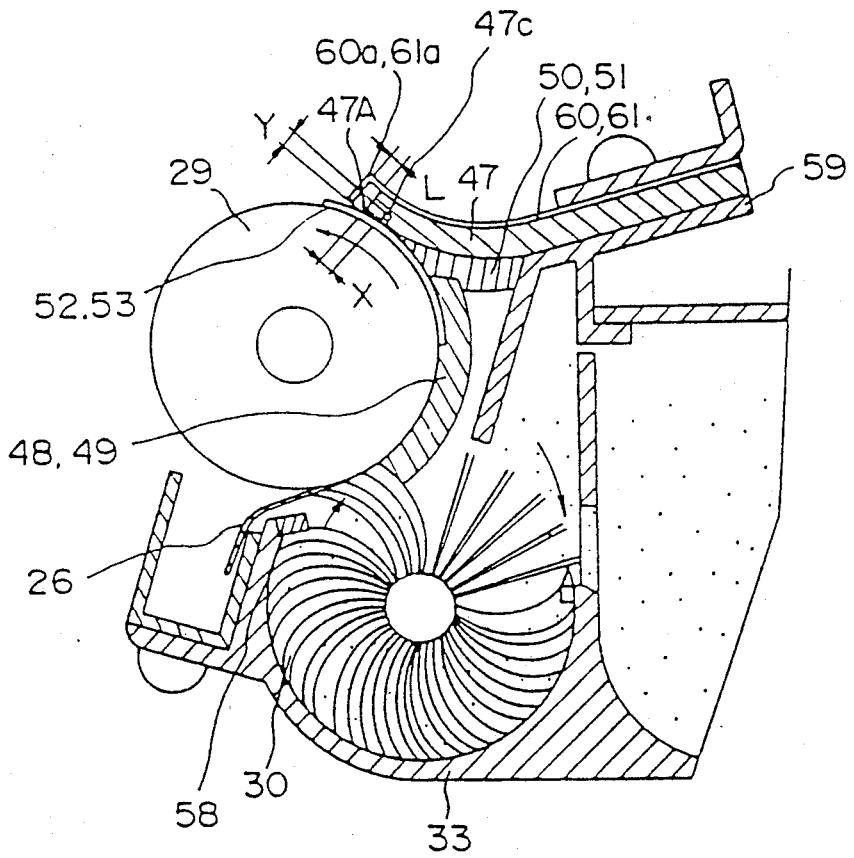
FIG. 17 is a cross-sectional view of a major part of a developing apparatus in accordance with a fifth embodiment of the present invention.

Description is made on a fifth embodiment of the present invention. FIG. 17 shows the fifth embodiment of the present invention. In FIG. 17, the same numbers are attached to the members having the same function as in the cases of the first through the fourth embodiments. The outer peripheral surfaces 29*a* and 29*b* of the both ends of the developing roller 29 are smooth, and a finely uneven-rough surface is formed on the central surface 29*c*. The surface roughness of the uneven-rough surface 29*c* is set to a maximum height of 1.5D–8D, R max, taking D as the average particle size of the developer 28. The fur brush 30 is installed in a manner that it is brought in slide-friction with the housing 33, and the tip thereof is deformed.

Figure 18:
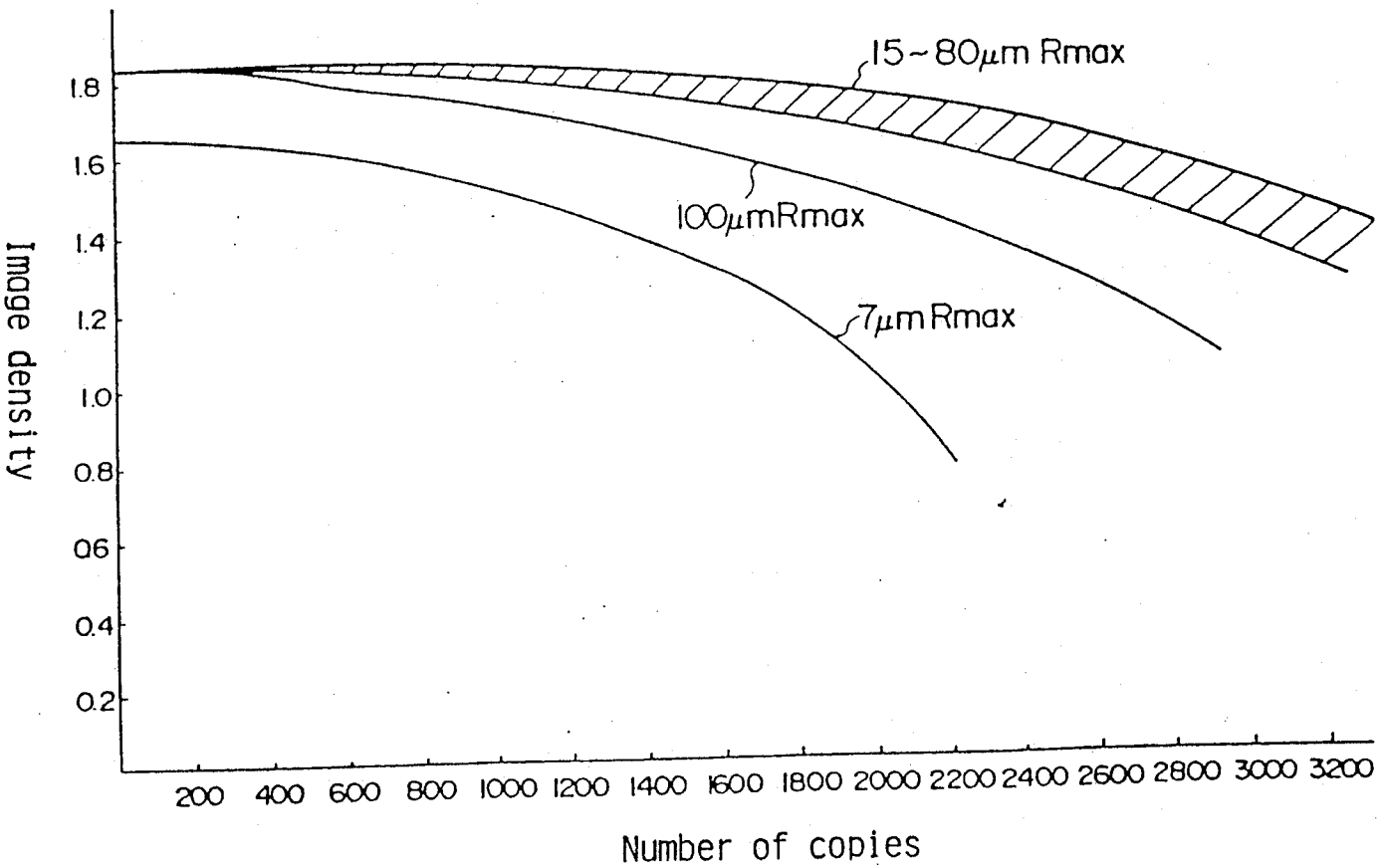
FIG. 18 is a graph showing the image density characteristic versus the number of copies.

Next, description is made on the operation in the fifth embodiment of the present invention. In FIG. 17, the fur brush 30 rotates and is brought in slide-friction with the housing 33, and thereby in the slide-friction part, the tip of a group of fibers of the fur brush 30 covers air gaps 66 among the adjacent fibers, and the area of contact with the developer 28 is vertually increased. Consequently, the developer 28 can be charged reliably. According, the developer 28 charged reliably on the developing roller 29 can fly and adhere, and therefore the rise time till a predetermined layer thickness is reached can be further reduced. And, when the surface roughness of the central surface 29*c* of the developing roller 29 is set to a maximum height of 1.5D–8D, R max (in this embodiment, D=10 μm, maximum height=-15–80 μm; R max) taking D as the average particle size of the developer 28, the image density characteristic versus the numaber of copies is stabilized as shown in FIG. 18.

Figure 19:
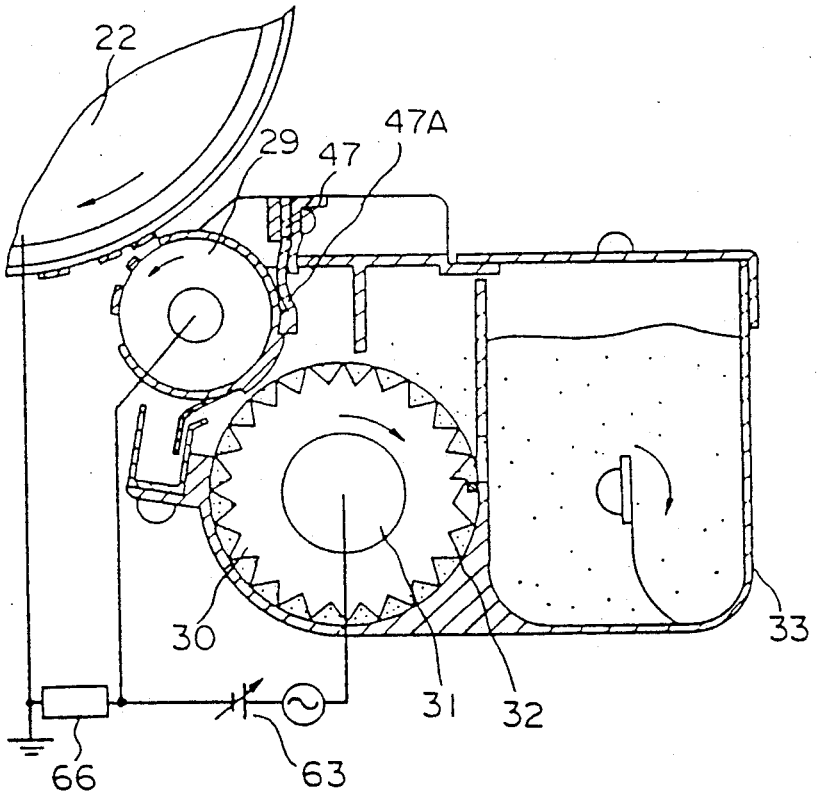
FIG. 19 is a cross-sectional view of a major part of a developing apparatus in accordance with a sixth embodiment of the present invention.

Next, description is made on a sixth embodiment of the present invention. FIG. 19 shows the sixth embodiment of the present invention, and the parts having the same function as in the case of the first embodiment are designated by the same numbers. In FIG. 19, the cylindrical elastic body 30 uses conductive sponge as the elastic material 32, and this is formed into a cylindrical roller around the aluminum core metal 31. In addition, it can be easily understood that actions of friction-charging, coating and the like as described in the first embodiment are performed effectively too, when conductive sponge is used as the elastic material 32 for the cylindrical elastic body 30. In this embodiment, the developing roller 29 and the cylindrical elastic body 30 face each other at nearby positions with keeping a constant distance (this distance is preferably 0.1–0.5 mm) kept. It is needless to say that even if such a distance is kept, as shown in the third embodiment, the charged developer 28 is carried to the developing roller 29.

Also for the layer thickness controlling member, the blade 47 of elastic body is used, and one end of the blade 47 is brought in press-contact with the surface of the developing roller 29 on the downstream side from the facing position of the developing roller 29 and the cylindrical elastic body 30 in the rotating direction of the developing roller 29 and on the upstream side from the part facing the photoreceptor-drum 22, and the other end is fixed to the housing 33 at the position where the above-mentioned one end acts to spread to the developing roller 29 side by a friction force receiving at the above-mentioned press-contact part when the developing roller 29 rotates. Furthermore, the shape of the press-contact part to the developing roller 29 is formed in a protruded shape. Numeral 66 designates a bias voltage applying means, which applies a DC bias voltage between the photoreceptor-drum 22 and the developing roller 29. The first voltage applying means 63 applies a voltage that a positive DC voltage is superposed on an AC voltage to the fur brush 30 side between the developing roller 29 and the fur brush 30, and thereby adjusts the layer thickness of the developer 28 charged on the surface of the developing roller 29.

Next, description is made on the operation of the sixth embodiment. In FIG. 19, by installing the first voltage applying means 63 which superposes a DC voltage on an AC voltage, the developer 28 can be coated with a predetermined layer thickness or thicker on the developing roller 29, and further the developer 28 adhering to the surface of the developing roller 29 after development is moved reciprocatively between the fur brush 30 and the developing roller 29 by the above-mentioned AC voltage to erase the hysteresis of the developing roller 29, and mutual agglomeration of the developer 28 and a strong adhering force of the developer 28 to the developing roller 29 can be prevented. Accordingly, a high-quality image without ghost can be obtained. And, since the press-contact part of the blade 47 is installed at the position where it acts to spread to the developing roller 29 side, a pool of the developer 28 is not produced between the developing roller 29 and the blade 47. Accordingly, an effect of preventing mutual agglomeration or solidification of the developer 28 is obtained. Furthermore, the press-contact part of the blade 47 with the developing roller 29 is formed in a protruded shape. Therefore, the facing distance between the developing roller 29 and the blade 47 after controlling the layer thickness is increased, and the charged developer 28 on the surface of the developing roller 29 never flies to the blade 47. Accordingly, more uniform coating can be carried out. Next, by applying a DC bias voltage between the photoreceptor-drum 22 and the developing roller 29 by the bias voltage applying means 66 when facing the electrostatic latent image on the photoreceptor-drum 22, the developer 28 is flied by a synergism of the electrostatic force generated by the electrostatic latent image and the electric field generated by the DC bias, and therefore the development can be carried out more effectively. In addition, the developing apparatus of this configuration can wall accommodate also for the case where the voltage of the bias voltage applying means 66 is an AC voltage or a DC voltage superposed by an AC voltage, and it can work without using the bias applying means.

In addition, it is needless to say that in the present invention, a large number of configurations can be further devised by combining various elements such as charging of the developer, coating onto the developing roller and controlling of the layer thickness in addition to the six embodiments as described above. Also, the present invention is well adapted to the non-magnetic one-component developer, and because of the configuration of non-contact with the charge holder, it is advantageous for forming a color image wherein plural-color developers are developed in a superposed manner on the charge holder.

INDUSTRIAL APPLICABILITY

As described above, in the developing apparatus of the present invention, by controlling the developer to be kept in a predetermined layer thickness by means of press-contact of the layer thickness controlling member with the developer carrier on the surface including at least the edge of the layer thickness controlling member on the downstream side in the moving direction of the developer carrier, agglomeration of toner and stripes in the rotating direction and in the axial direction of the developer carrier are produced on the developer carrier, and the layer thickness and the amount of charge of the developer on the developer carrier are equalized. As a result, unevenness of density, scattering of developer and the like do not take place, and a high-image-quality development can be carried out.

We claim:

1. A developing apparatus comprising:

an endless-shaped developer carrier;

a supplying means for supplying a developer onto said developer carrier;

a layer thickness controlling member including a blade having an elastic body, for controlling the developer brought into press-contact with said developer carrier on a downstream side from a developer supplying position of said supplying means in a moving direction of said developer carrier to a predetermined layer thickness, said layer thickness controlling member having a surface having at least one edge for press-contacting said developer carrier and having notches for cleaning the developer adhering to outer peripheral surfaces of said developer carrier, formed on both end surfaces of said layer thickness controlling members contacting said outer peripheral surfaces of said developer carrier;

a first sealing member for cutting off the developer moving to both ends of said developer carrier, said first sealing member for the developer surrounding said outer peripheral surfaces of said both ends of said developer carrier; and a second sealing member for shielding a junction of said developer carrier, said first sealing member and the layer thickness controlling member.

2. A developing apparatus in accordance with claim 1, wherein said developer carrier has a surface formed into an uneven-rough surface, and the roughness of the uneven-rough surface is set to a maximum height of 1.5D–8D Rmax, where D is the average particle size of the developer.

3. A developing apparatus comprising:

an endless-shaped developer carrier;

a supplying means for supplying a developer onto said developer carrier;

a layer thickness controlling member for controlling the developer brought into press-contact with said developer carrier on a downstream side from a developer supplying position of said supplying means in a moving direction of said developer carrier to a predetermined layer thickness, said layer thickness controlling member having a surface containing at least one edge for press-contacting with said developer carrier; a first sealing member for cutting off the developer moving to both ends of said developer carrier, said first sealing member for the developer surrounding outer peripheral surfaces of said both ends of said developer carrier;

a second sealing member for shielding a junction of said developer carrier, said first sealing member and the layer thickness controlling member; and a sheet-shaped elastic body for cutting off the developer moving to said both ends of said developer carrier, surrounding a part of said outer peripheral surfaces at said both ends of said developer carrier, installed between said layer thickness controlling member and said developer carrier at over limited area of said both ends of said developer carrier.

4. A developing apparatus in accordance with claim 3, wherein said developer carrier has a surface formed into an uneven-rough surface, and the roughness of the uneven-rough surface is set to a maximum height of 1.5D–8D Rmax, where D is the average particle size of the developer.

* * * * *